US007452226B2

(12) United States Patent
Rabotti

(10) Patent No.: US 7,452,226 B2
(45) Date of Patent: Nov. 18, 2008

(54) PLUG-IN CONNECTOR

(75) Inventor: Tomasso Rabotti, Ravenna (IT)

(73) Assignee: Selta S.r.l., Calderino Di Monte S. Pietro (IT)

( * ) Notice: Subject to any disclaimer, the term of this patent is extended or adjusted under 35 U.S.C. 154(b) by 0 days.

(21) Appl. No.: 11/911,370

(22) PCT Filed: Apr. 14, 2006

(86) PCT No.: PCT/IB2006/000883

§ 371 (c)(1),
(2), (4) Date: Oct. 12, 2007

(87) PCT Pub. No.: WO2006/109163

PCT Pub. Date: Oct. 19, 2006

(65) Prior Publication Data

US 2008/0153316 A1 Jun. 26, 2008

(30) Foreign Application Priority Data

Apr. 14, 2005 (IT) ..... BO2005A0237

(51) Int. Cl.
*H01R 13/64* (2006.01)

(52) U.S. Cl. ..... 439/248; 439/34; 439/406

(58) Field of Classification Search ..... 439/34, 439/248–249, 406

See application file for complete search history.

(56) References Cited

U.S. PATENT DOCUMENTS 3,523,273 A * 8/1970 Hammell et al. ..... 439/249
3,990,767 A 11/1976 Narozny et al.
5,122,066 A * 6/1992 Plossmer ..... 439/78
5,201,663 A * 4/1993 Kikuchi et al. ..... 439/83
5,504,654 A * 4/1996 Knox et al. ..... 361/119
5,769,652 A * 6/1998 Wider ..... 439/248
6,276,946 B1 8/2001 Stephan
6,530,796 B2 3/2003 Benz et al.
6,616,476 B1 * 9/2003 Moritz et al. ..... 439/404

FOREIGN PATENT DOCUMENTS

WO WO86/03626 A1 6/1986

OTHER PUBLICATIONS

International Search Report.

* cited by examiner

*Primary Examiner*—Truc T Nguyen
(74) *Attorney, Agent, or Firm*—William J. Sapone; Coleman Sudol Sapone P.C.

(57) ABSTRACT

A plug-in connector (10) for a control unit (100) of a window opener in a motor vehicle, including a box-like housing (1). The plug-in connector (10) includes a plurality of motor connections (2), situated in corresponding longitudinal seats (4). Each motor connection (2) includes a base (21), partially embedded in the box-like housing (1) and a terminal, clamp portion (22), which engages with a relative comb connector (3) of the complementary female connector. A longitudinal slot (25) is made in an intermediate portion (24) of the connection (2). The areas (26*a*, 27*a*) joining longitudinal prongs (26, 27) and the base (21), and the areas (26*b*, 27*b*) joining the prongs and the clamp portion (22), deform, like hinge points of a pivot parallelogram.

9 Claims, 2 Drawing Sheets

PLUG-IN CONNECTOR

FIELD OF THE INVENTION

The present invention relates to electric connection devices. In particular, the invention relates to a sliding, plug-in connector, which can be e.g. connected to a control unit of an electric motor operated window driver in a motor vehicle.

BACKGROUND OF THE INVENTION

In the automotive field construction, electrically driven window driver are used, comprising different functional units, which are installed during the vehicle assemblage.

The functional units include a motor group and a related control unit.

The motor includes generally a female electric supply connector, formed by a shell, having a suitably shaped recess, and a plurality of connections, usually grouped in a comb-connector, situated inside the recess.

The control unit includes a box-like housing made out of plastic material, obtained preferably by molding, which forms, on one side a male connector, complementary to the before mentioned recess of the motor connector, and on the other side, a power supplying jack, which receives a voltage from the vehicle battery.

A printed circuit board, containing the motor control electronics, is also fastened to one surface of the box-like housing.

The male connector includes a plurality of motor connections, usually two, partially embedded in the box-like housing.

The motor connections protrude from the housing in a position corresponding to the printed circuit board with suitable feet welded onto the board bump outlet contacts, and in a position corresponding to the male connector with elastic clamps, which press tightly the above mentioned comb connector, so as to assure a suitable electric contact in any use condition.

Likewise, the plug includes a pair of connections, partially embedded in the box-like housing and having feet protruding from the box-like housing in a position corresponding to the supply bump connections of the printed circuit board.

The above described control unit is coupled with the related motor group by introducing the male connector of the control unit into the female connector of the motor group.

In this way, the comb connector is inserted gliding between opposite segments of corresponding motor connections.

The segments deform slightly and ensure a correct electric contact, due to the elastic return force, which they perform on the motor connections.

A drawback, usually reported in relation to the above described connectors, results from the fact that the mutual positioning of the comb connector and the motor connections during the coupling between the male connector and the female connector is not always as good as it would be necessary, due to the construction and assembly imperfections.

Actually, a misalignment created between the above mentioned connections can prevent or make difficult their coupling.

The U.S. Pat. No. 5,112,235 and U.S. Pat. No. 5,306,169 describe technical solutions, which allow the adapting of the terminal portion of connections of an electric connector.

According to these solutions, an elastic element is provided between the body of each connection and its terminal portion.

This allows the latter to perform slight oscillations, so as to adapt to the misalignment of the corresponding counter-connection.

The U.S. Pat. No. 6,530,796, granted to Robert Bosch GmbH, describes a connector of a window control drive unit of the above described type.

This connector resolves the above mentioned drawback by narrowing of the upstream part of each motor connection segment.

In this way, the connection terminal portion, defined by a clamp, can perform slight oscillations on a transversal axis passing through the narrowing, so as to adapt elastically to the misalignment of the comb connector.

The technical solutions described in the above cited documents do not resolve the problem satisfactorily.

Actually, the clamps tend to compensate for the misalignment with the comb connector by rotations, which anyway cause a misalignment between the comb connector and the clamp.

The misalignment between the comb connector and the clamp can cause an imperfect electric connection and eventually, it can weaken the clamp structure, due to the vibrations, to which each element of a motor vehicle is inevitably subjected.

SUMMARY OF THE INVENTION

The main object of the present invention is to propose an electric connector, of the plug-in type with elastic clamps, which can compensate for possible misalignments between the comb connector, maintaining the clamps aligned with the connections.

Another object of the present invention is to propose a connector, in which such a compensation does not cause unbalance in the coupling between the motor connections and the corresponding comb connector.

A further object of the present invention is to propose a connector, in which such a compensation is obtained in a simple and cheap way.

A still further object of the present invention is to propose a particularly strong and reliable connector, which ensure always best electric contacts.

The above mentioned objects are obtained, in accordance with the contents of the claims, by a plug-in connector, associated to a control unit of a window control unit in a motor vehicle, the plug-in connector including a box-like housing with a portion shaped in such a way, as to couple precisely with a corresponding complementary connector of a motor group of said window opener; and at least one motor connection, whose base is partially embedded in said box-like housing and whose terminal, clamp portion engages with a relative comb connector of said complementary connector, to establish an electric contact therewith, said plug-in connector being characterized in that each motor connection has a longitudinal slot, situated in an intermediate portion of said connection, between said base and clamp portion, to define, in said intermediate portion, a pair of longitudinal prongs, areas joining said prongs and said base, and areas joining said prongs and said clamp portion, deforming, due to stresses applied to said clamp portion, like hinge points of a pivot parallelogram, so that said clamp portion translates in a direction substantially perpendicular to its longitudinal axis.

BRIEF DESCRIPTION OF THE DRAWINGS

The characteristic features of the invention, which will result from the claims, are pointed out in the following detailed description, with reference to the enclosed figures, in which:

BEST MODES OF CARRYING OUT THE INVENTION

Figure 1:
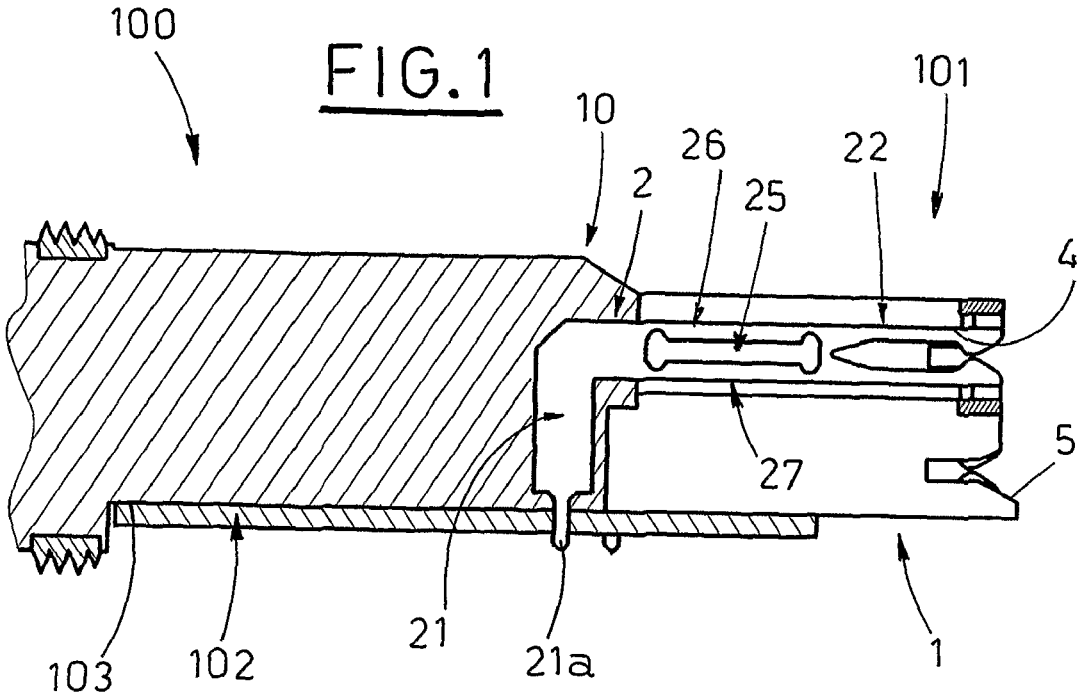
FIG. 1 is a schematic, lateral, partially section view of a window control unit, equipped with the connector proposed by the present invention.
Figure 2:
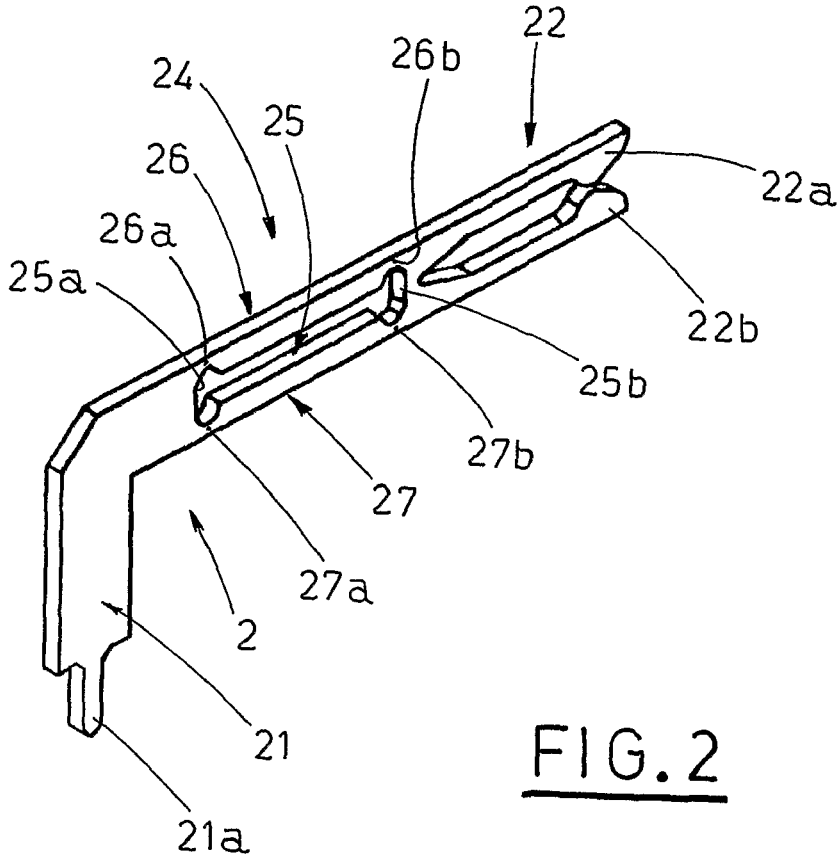
FIG. 2 is a perspective view of a motor connection of the connector of FIG. 1.

FIG. 1 shows a preferred, but not exclusive embodiment of the present invention.

The above Figure shows schematically an important portion of a window opener control unit 100.

The control unit 100 includes a box-like housing 1, obtained from a suitable plastic material by molding, in which a portion 101 is made, shaped in such a way, as to be inserted precisely into the housing of a corresponding female connector of a window opener motor group.

The shaped portion 101 forms the coupling section of a plug-in connector 10, obtained in accordance with the invention.

The control unit 100 includes also an electric supply connector of known type, not shown in Figure, and a printed circuit board 102, which contains the window opener control electronics.

The board 102 is fastened to a lower surface 103 of the box-like housing 1, and is electrically connected to the above mentioned supply connector.

The plug-in connector 10 of the invention is substantially formed by a part of the box-like housing 1, including the above mentioned shaped portion 101, and a plurality of motor connections 2, two in the shown embodiment.

Figure 3:
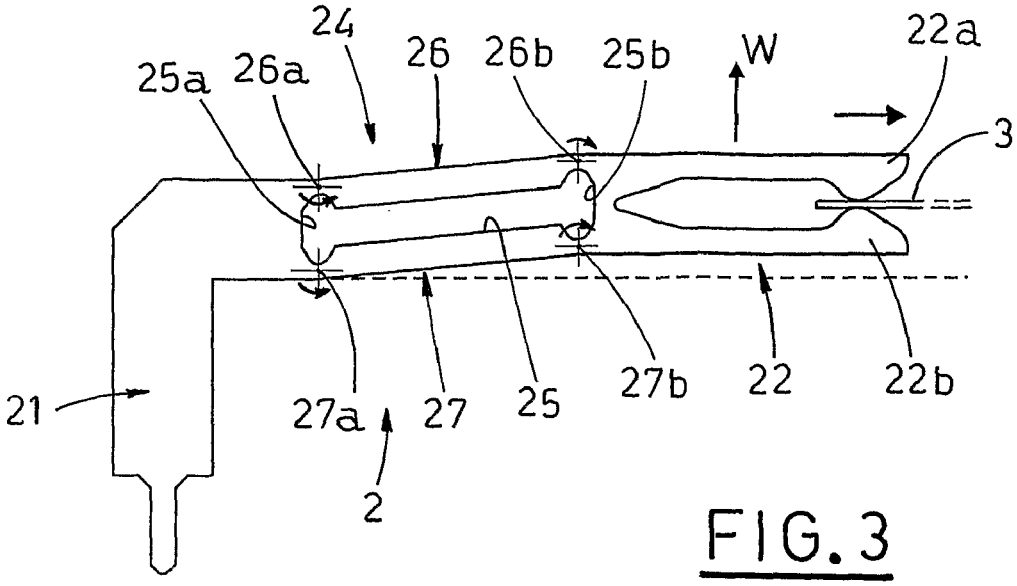
FIG. 3 is a lateral view of the motor connection of FIG. 2, in compensation for the misalignment with respect to a corresponding comb connector.

The motor connections 2 are aimed at coupling with a corresponding comb connector 3, made in the female connector of the motor group (see also FIG. 3).

Each of the motor connections 2 includes an L-like plate made of a suitable, metallic material, obtained by mechanical or chemical cutting.

A base 21 of the motor connection 2 is partially embedded in the box-like housing 1.

One end of the base 21 protrudes from the housing 1 in a position corresponding to the lower surface 103 with a foot 21*a*, aimed at being welded to a bump outlet contact of the board 102.

The opposite end of the base 21 protrudes in a position corresponding to a seat 4, made in the shaped portion 101, in the direction of the introduction of the plug-in connector 10 into the relevant female connector and with the end open.

Obviously, according to other embodiments of the invention, a different number of feet 21*a* can be provided, according to the requirements of the contact conduction or mechanical resistance.

The motor connection 2 extends in the seat 4 with an intermediate portion 24, next to the free end of the base 21, and then with a clamp portion 22, formed by a pair of elastic prongs 22*a*, 22*b*, facing each other.

A longitudinal slot 25 is made in the intermediate portion 24, to define in the latter a pair of longitudinal prongs 26, 27.

In particular, the ends 25*a*, 25*b* of the slot 25 are widened and rounded.

Areas 26*a*, 27*a* of union between the prongs 26, 27 and the base 21, and areas 26*b*, 27*b* of union between the prongs and the clamp portion 22, are defined in correspondence to the ends 25*a*, 25*b*.

The width of the union areas is suitably reduced, for the reasons explained later.

Figure 4:
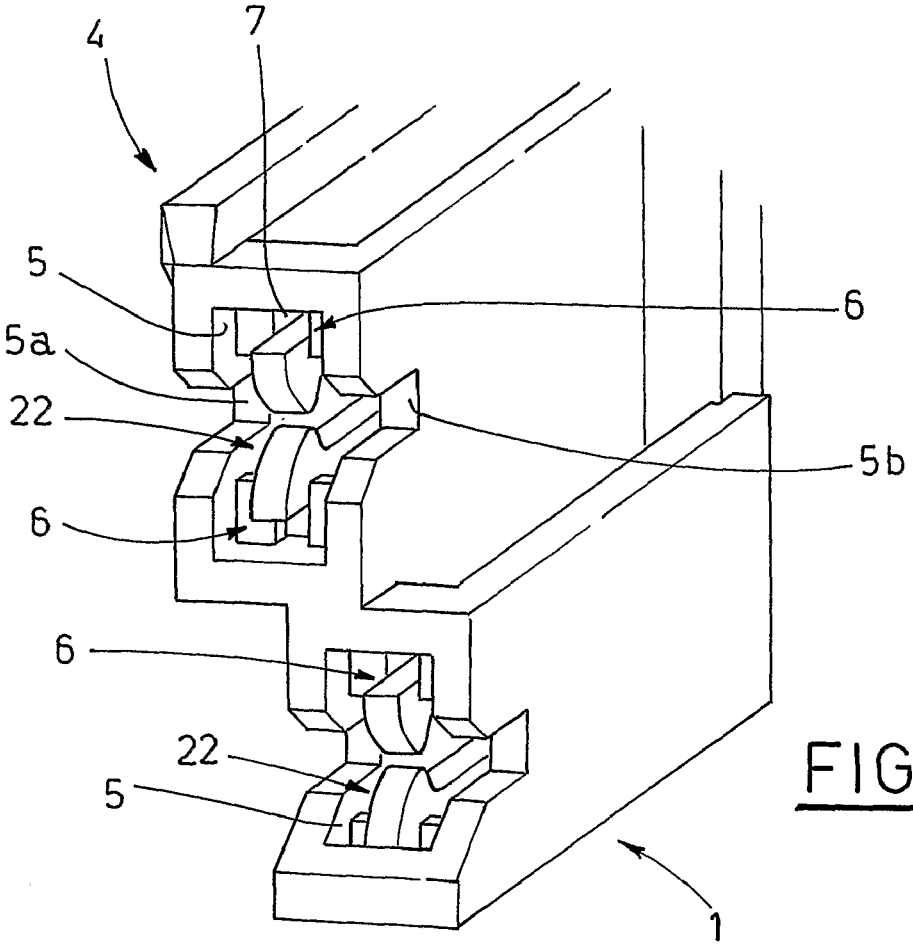
FIG. 4 is a perspective, angled view of the connector of FIG. 1.

The end of the clamp portion 22 protrudes from an opening 5, made at the end of each seat 4 (see FIG. 4).

A pair of horizontal grooves 5*a*, 5*b* are made at the sides of the opening 5, to allow the coupling between the clamp 22 and the corresponding comb connector 3.

A plurality of inner protrusions 6, made near the opening 5, are arranged lateral with respect to the clamp portion 22 and define a passage 7, perpendicular to the axis of the clamp 22 and aimed at allowing the latter to translate only perpendicularly to its axis.

By translating the whole control unit 100, in order to insert precisely the shaped portion 101 thereof into the corresponding complementary seat of the female connector of a motor group, the above described motor connections 2 couple with the respective comb connector 3, as already said.

If the position of one or more connections of the comb connector 3 is offset with respect to the axis of the clamp 22 of the corresponding motor connection 2 (situation shown in FIG. 3), the clamp 22 is stressed transversely in a direction indicated with the arrow W.

This stress is transmitted to the union areas 26*a*, 27*a*; 26*b*, 27*b*, which tend to act, during the movements, like as many hinges of a pivot parallelogram formed by the terminal portion of the base 21, the longitudinal prongs 26, 27, and the clamp portion 22.

Consequently, the clamp portion 22 translates in the direction W without changing the orientation of its axis, as shown in FIG. 3.

The deformation of the union areas 26*a*, 27*a*; 26*b*, 27*b* can be plastic, thus permanent, or elastic, thus reversible, depending on the used material and the width of the areas.

Although both types are used in the present invention, the permanent deformations are normally preferred.

Actually, in this way, there are no in-operation stresses on the clamp 22, and consequently, the elastic grip of the clamp prongs 22*a*, 22*b* on the comb connector 3 is kept perfectly balanced and ensures best electric contact.

Consequently, the above described technical solution is particularly advantageous in critical applications, such as motor vehicle field, and it is also cheap and reliable.

It is understood that what above has been described as a mere, not limiting example. Therefore, it is obvious that any possible changes or variants, relative e.g. to the shape of the motor connections or their housings and casings, applied thereto remain within the protective scope defined by the following claims.

The invention claimed is:

1. A plug-in connector, associated to a control unit (100) of a window control unit in a motor vehicle, the plug-in connector including a box-like housing (1) with a portion (101) shaped in such a way, as to couple precisely with a corresponding complementary connector of a motor group of said window opener; and at least one motor connection (2), whose base (21) is partially embedded in said box-like housing (1) and whose terminal, clamp portion (22) engages with a relative comb connector (3) of said complementary connector, to establish an electric contact therewith, said plug-in connector (10) being characterized in that each motor connection (2) has a longitudinal slot (25), situated in an intermediate portion (24) of said connection (2), between said base (21) and clamp portion (22), to define, in said intermediate portion (24), a pair of longitudinal prongs (26, 27), areas (26*a*, 27*a*) joining said prongs (26, 27) and said base (21), and areas (26*b*, 27*b*) joining said prongs and said clamp portion (22), deforming, due to stresses applied to said clamp portion (22), like hinge points of a pivot parallelogram, so that said clamp portion (22) translates in a direction substantially perpendicular to its longitudinal axis.

2. A connector, as claimed in claim 1, wherein the ends (25*a*, 25*b*) of said slot (25) are widened, to make said joining areas (26*a*, 27*a*; 26*b*, 27*b*) correspondingly narrower and to facilitate the deformation thereof.

3. A connector, as claimed in claim 1, wherein the deformation of the joining areas (26*a*, 27*a*; 26*b*, 27*b*) is permanent.

4. A connector, as claimed in claim 1, wherein the deformation of the joining areas (26*a*, 27*a*; 26*b*, 27*b*) is elastic.

5. A connector, as claimed in claim 1, wherein each of said terminal clamp portions (22) is housed in a corresponding seat (4) of the box-like housing (1), with said seat (4) having an opening (5), in a position corresponding to the end of said clamp portion (22), for coupling of the clamp portion (22) with the comb connector (3).

6. A connector, as claimed in claim 2, wherein said ends (25*a*, 25*b*) of said slot (25) are rounded.

7. A connector, as claimed in claim 5, wherein a plurality of inner protrusions (6) are made near said opening (5), in said seat (4), arranged laterally with respect to said clamp portion (22) and defining a passage (7), for making said clamp translate only perpendicularly to its axis.

8. A connector, as claimed in claim 2, wherein the deformation of the joining areas (26*a*, 27*a*; 26*b*, 27*b*) is permanent.

9. A connector, as claimed in claim 2, wherein the deformation of the joining areas (26*a*, 27*a*; 26*b*, 27*b*) is elastic.

* * * * *